US006227646B1

(12) United States Patent
Yano et al.

(10) Patent No.: US 6,227,646 B1
(45) **Date of Patent: *May 8, 2001**

(54) INK JET RECORDING APPARATUS

(75) Inventors: Kentaro Yano, Yokohama; Naoji Ohtsuka, Kawasaki; Hiromitsu Hirabayashi, Yokohama; Hitoshi Sugimoto, Kawasaki; Miyuki Matsubara, Tokyo; Kiichiro Takahashi, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 07/953,117

(22) Filed: Sep. 29, 1992

(30) Foreign Application Priority Data

Oct. 2, 1991 (JP) ..... 3-255196

(51) Int. Cl.[7] ..... B41J 2/165

(52) U.S. Cl. ..... 347/23; 347/22; 347/30; 347/35

(58) Field of Search ..... 346/140 R, 75; 347/23, 30, 35, 33, 22

(56) References Cited

U.S. PATENT DOCUMENTS

| | | | | |
|---|---|---|---|---|
| 4,176,363 | * | 11/1979 | Kasahara | 346/140 R |
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,558,333 | | 12/1985 | Sugitani et al. . | |
| 4,608,577 | | 8/1986 | Hori . | |
| 4,692,777 | | 9/1987 | Hasumi . | |
| 4,723,129 | | 2/1988 | Endo et al. . | |
| 4,740,796 | | 4/1988 | Endo et al. . | |
| 5,172,140 | | 12/1992 | Hirabayashi et al. . | |
| 5,475,404 | * | 12/1995 | Takahashi et al. | 347/23 |

FOREIGN PATENT DOCUMENTS

| | | | | |
|---|---|---|---|---|
| 0427202 | * | 5/1991 | (EP) | B41J/2/165 |
| 0442470 | | 8/1991 | (EP) . | |
| 0442711 | | 8/1991 | (EP) . | |
| 54-056847 | | 5/1979 | (JP) . | |
| 59-123670 | | 7/1984 | (JP) . | |
| 59-138461 | | 8/1984 | (JP) . | |
| 60-071260 | | 4/1985 | (JP) . | |
| 1202454 | | 8/1989 | (JP) . | |
| 3-218846 | * | 9/1991 | (JP) | 347/23 |

* cited by examiner

*Primary Examiner*—Thinh Nguyen
(74) *Attorney, Agent, or Firm*—Fitzpatrick, Cella, Harper & Scinto

(57) ABSTRACT

If it is detected that the number of times of ejection recovery operations performed in the past by the request of a user during an ink jet recording operations is greater than or equal to a designated relatively large value, for example "2", the ink jet recording apparatus judges that an ejection recovery operation is relatively necessary for itself and that the number of times of ejection recovery operations to be performed when the electric power supply is turned on is increased. As a result in the ink jet recording apparatus, it will be appreciated that an optimal ejection recovery operation can be established in response to an operational condition of the ink jet recording apparatus and that the unnecessary waste of ink fluids can be prevented and the size of the recording apparatus can be reduced.

17 Claims, 8 Drawing Sheets

| | |
|---|---|
| n | THE NUMBER OF TIMES OF EJECTION RECOVERY OPERATIONS AT TURN-ON OF POWER SUPPLY : P |
| n+1 | THE NUMBER OF TIMES OF AUTOMATIC EJECTION RECOVERY OPERATIONS (TOTAL NUMBER 0F TIMES) : AP |
| n+2 | THE NUMBER OF TIMES OF MANUAL EJECTION RECOVERY OPERATIONS (TOTAL NUMBER OF TIMES) : mP |
| ⋮ | |
| | |
| m | I |
| ⋮ | |
| | |
| | |
| | |
| | |
| | |
| | |
| | |

FIG. 3

INK JET RECORDING APPARATUS

BACKGROUND OF THE INVENTION

1. Field of the Invention

The present invention relates to an ink jet recording apparatus, and more particularly to an ink jet recording apparatus with the mechanism for ejection recovery procedure.

2. Description of Prior Art

In recent years, a personal computer, a word processor, etc., are widely used. As a recording system for printing out information which was inputted and processed in these apparatus, a variety of recording systems are known, such as a wire dot system, a thermal transfer system and an ink jet system. In these recording systems, recording is made on recording sheets which are relatively transported with respect to the recording head, and there are differences in structure of the recording heads according to those systems.

In the recording heads of the ink jet type, the recording is made by ejecting ink from relatively small orifices. Therefore, in this type recording heads, clogging of the orifices or a deflection of ejected ink may be occurred owing to an increase in ink viscosity due to the evaporation of a solvent, or the dust attached to the orifices and its vicinity and the recording may fail to be made. In order to prevent such a problem, most ink jet recording apparatus are provided with an ejection recovery mechanism for forced discharging the ink in a more viscous state from the recording head by means of pressurizing or sucking it.

In the conventional system, the ejection recovery operation by the forced ink discharge as described above is automatically carried out, when a user operates a recovery switch provided to the ink jet recording apparatus, or just after switch-on of a power source, or every time a constant time elapses from the previous recovery operation.

However, in the case that the user operates the recovery switch, in the conventional system as described above, it is very difficult for the user to decide that the recovery switch should be pressed when the ink jet recording apparatus is in any states. In addition, it is troublesome for the user to operate the recovery switch, and there is a problem that consumption of ink increases when the user would operates the recovery switch for unnecessary recovery procedure.

Further, in the case that the ejection recovery operation is automatically carried out just after switch-on of a power source, unnecessary recovery procedure is often performed when the user often operates a power switch, thus consumption of ink increases.

Further, in the case that the ejection recovery operation is automatically carried out every time a constant time elapses, it is necessary to provide a timer for counting a time interval of the recovery operations. Because the timer must count the elapsed time even when the power source is switched off, it is necessary to provide such as a back-up power source. Life time of the back-up power source is generally shorter than that of the apparatus. It is therefore necessary to exchange the back-up power source for a new one by the user. Accordingly, it is troublesome. In addition, because the optimum time interval greatly depends on the frequency of use of the recording apparatus itself, it is difficult to preset the optimum time interval.

In the above-described manners, the consumption of ink increases as the number of times of the ejection recovery operation increases. Therefore, larger ink tank for the discharged ink is required, and it becomes difficult to make the recording apparatus smaller.

Further, in such an apparatus that an absorber for the discharged ink is used, it is usually necessary to provide a large quantity of absorber. In this case, the whole volume of the absorber becomes larger, because it is necessary to take an acceptable limit into consideration.

SUMMARY OF THE INVENTION

It is an object of the present invention to provide an ink jet recording apparatus, wherein it is not required to count the time intervals when the electric power supply is turned off, wherein an optimum ejection recovery operation can be established in response to an operational condition and frequency of use of the recording apparatus, so that the unnecessary waste of ink fluid can be prevented, and wherein the size of the recording apparatus can be reduced.

In the first aspect of the present invention, an ink jet recording apparatus using a recording head and recording by ejecting an ink fluid from the recording head onto a recording medium comprises;

an ejection recovery means for performing an ejection recovery operation for maintaining an ejection condition of the recording head to be good by causing the ink fluid to flow in the recording head;

a memory means for memorizing an amount with respect to the ejection recovery operation performed by the ejection recovery means; and a recovery operation amount control means for controlling the ejection recovery operation to be performed by the ejection recovery means in responsive to the amount memorized by the memory means.

Here, the amount memorized by the memory means may be the number of times of the ejection recovery operations.

The amount memorized by the memory means may be the number of times of the ejection recovery operations performed in response to a command of a user of the ink jet recording apparatus in relation to the number of times of the ejection recovery operations performed automatically in the ink jet recording apparatus.

The recovery operation amount control means may control the number of times of the ejection recovery operations performed by the ejection recovery means when an electric power supply to the ink jet recording apparatus is turned on, and/or a time interval between the ejection recovery operations performed by the ejection recovery means after the electric power supply is turned on.

The number of times of the ejection recovery operations and/or the time interval between the ejection recovery operations may be controlled in responsive to temperature and/or humidity with respect to the recording head.

The time interval between the ejection recovery operations may be able to be changed.

The recording head may generate a bubble by using thermal energy, and ejects an ink fluid accompanied by generation of the bubble.

The recovery operation amount control means may control the amount of causing the ink fluid to flow during the ejection recovery operation.

The amount of causing the ink fluid to flow during the ejection recovery operation may be controlled in responsive to temperature and/or humidity with respect to the recording head.

The recording head may generate a bubble by using thermal energy, and ejects an ink fluid accompanied by generation of the bubble.

In the second aspect of the present invention, an ink jet recording apparatus using a recording head and recording by ejecting an ink fluid from the recording head onto a recording medium comprises;

an ejection recovery means for performing an ejection recovery operation for maintaining an ejection condition of the recording head to be good by causing an ink fluid to flow in the recording head;

a memory means for memorizing a duration time during which an electric power is continuously supplied to the ink jet recording apparatus; and recovery operation amount control means for controlling the ejection recovery operation to be performed by the ejection recovery means in responsive to the duration time memorized by the memory means.

The duration time may be an average of a plurality of duration times in each of which the electric power supply is turned on.

The recovery operation amount control means may control the number of times of the ejection recovery operations performed by the ejection recovery means when an electric power supply to the ink jet recording apparatus is turned on, and/or a time interval between the ejection recovery operations performed by the ejection recovery means after the electric power supply is turned on.

In the third aspect of the present invention, an ink jet recording apparatus using a recording head and recording by ejecting an ink fluid from the recording head onto a recording medium comprises;

an ejection recovery means for performing an ejection recovery operation for maintaining an ejection condition of the recording head to be good by causing an ink fluid to flow in the recording head;

a detecting means for detecting an occurrence of operating the ink jet recording apparatus; and a recovery operation amount control means for controlling the ejection recovery operation to be performed by the ejection recovery means in responsive to the occurrence of operating the ink jet recording apparatus detected by the detecting means.

According to THE above construction, the number of times of ejection recovery operations is determined based on an amount of ejection recovery operations performed in the past and the frequency of use of the recording apparatus for recording. Owing to this way, an adequate ejection recovery operation can be established in accordance with the operational condition of the recording apparatus and its occurrence of operations.

BRIEF DESCRIPTION OF THE DRAWINGS

FIG. 3 is a diagram showing a content of EEPROM shown in FIG. 2;

DETAILED DESCRIPTION OF PREFERRED EMBODIMENTS

In the followings, by referring to accompanying drawings, embodiments of the present invention are more fully described in the detailed description.

(EMBODIMENT 1)

Figure 1:
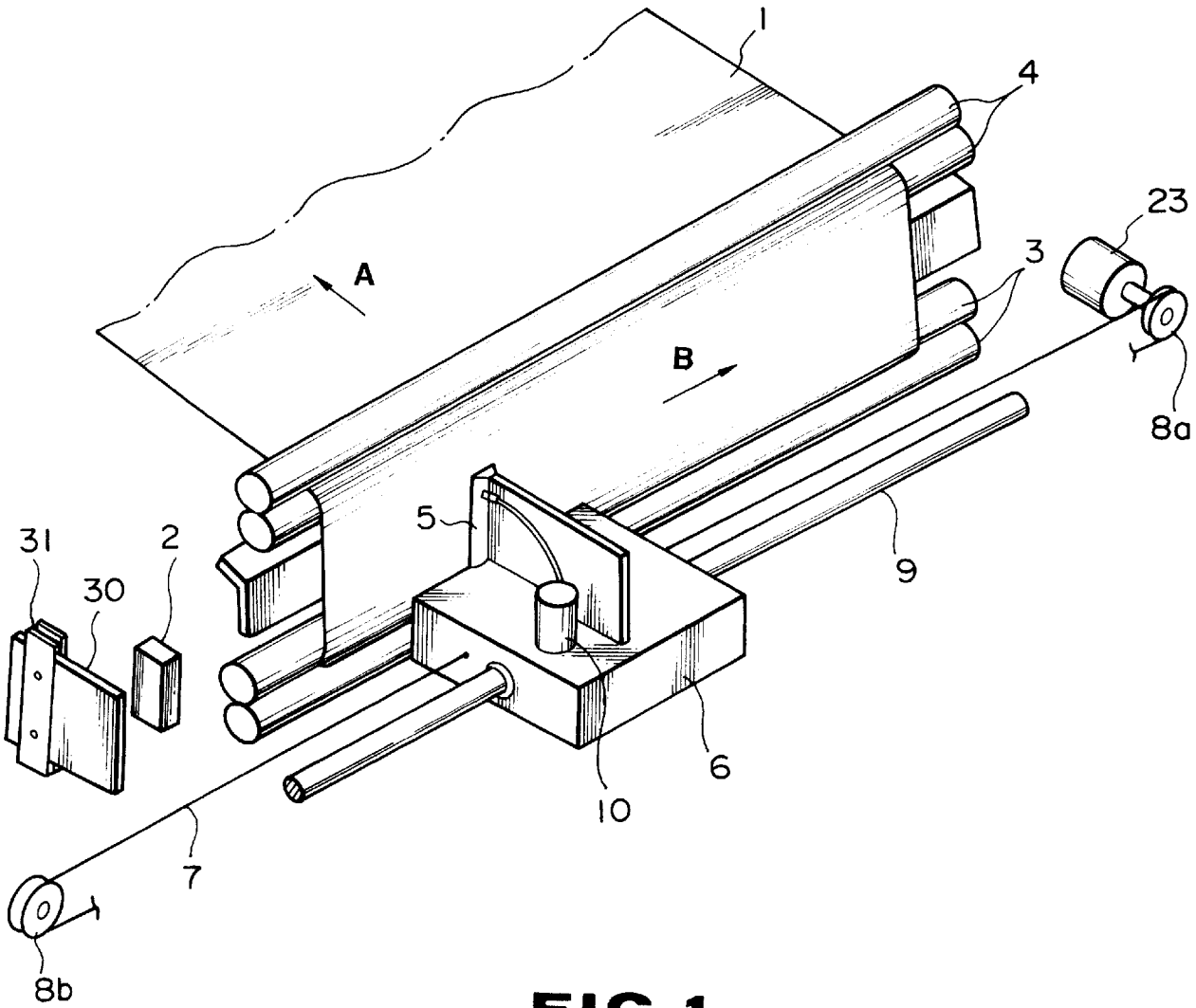
FIG. 1 is a diagrammatic perspective view showing an ink jet recording apparatus of embodiment of the present invention.

FIG. 1 is a diagrammatic perspective view of an ink jet recording apparatus of this embodiment.

What is explained at first is an overall configuration of the ink jet recording apparatus. In FIG. 1, a recording sheet 1 as a recording medium is composed of paper or plastic sheet materials. A plurality of sheets 1 stacked in a casette not shown in FIG. 1 are supplied separately by the sheet feed roller not shown in the figure. An individual sheet 1 fed into the recording apparatus is transported in the direction shown by an arrow "A" by a pair of the first rollers 3 and a pair of the second rollers 4. These pairs of rollers are placed with a designated distance, each of which is driven by an individual stepping motor not shown in the figure.

Ink fluid is supplied from the ink cartridge not shown in the figure through the sub-tank 10 to the recording head 5 for performing recording operations by ejecting ink fluids onto the recording sheet 1. The recording head 5 ejects ink fluids from each of a plurality of orifices arranged in the direction in which the recording sheet 1 is fed in responsive to the recording image signals. This ink jet recording method uses a mechanism in which an individual electro-thermal converting element 51 formed in each of an ink path 52 connected to each of orifices 53 of the recording head 5 generates heat in responsive to the above recording image signals and ink fluids are ejected from the orifice due to bubble generated by the generated heat in the ink fluid. The recording head 5 and the sub-tank 10 are mounted on the carriage 6. A part of the belt 7 is connected to the carriage 6 and the belt 7 is extended between pulleys 8*a* and 8*b*. The pulley 8*a* is fixed on the rotating shaft of the carriage motor 23. Owing to this structure, the carriage 6 can move forward and backward along the guide shaft 9 in responsive to the rotational movement of the carriage motor 23.

In the above structure, the recording head 5 moves in the direction shown by the arrow "B" in the figure and ejects ink fluids onto the recording sheet 1 in responsive to the recording image signals in order to record images or characters onto the recording sheet. The recording head 5 moves back to a home position defined at the left end part of a movable range of the recording head 5 along the guide shaft 9, in which the ejection recovery operation is performed for the recording head 5. At the home position, an ejection recovery apparatus 2 and a blade 30 used for performing an ejection recovery operation in order to remove sticky ink fluids plugged inside the orifices of the recording head. Every time when a recording operation of one line on the recording sheet as the recording head 5 moves along the guide shaft 9, pairs of feed rollers 3 and 4 are driven to transport the recording sheet 1 in the direction shown by an arrow "A" by the pitch equivalent to the height of a single recorded line on the recording sheet. By repeating these recording operations, designated recording images are recorded onto the recording sheet. The blade 30 placed adjacent to the recovery apparatus 2 contacts to an orifice-disposed surface of the recording head 5 as the movement of the recording head 5 so as to remove water drops or dusts on the surface.

Figure 2:
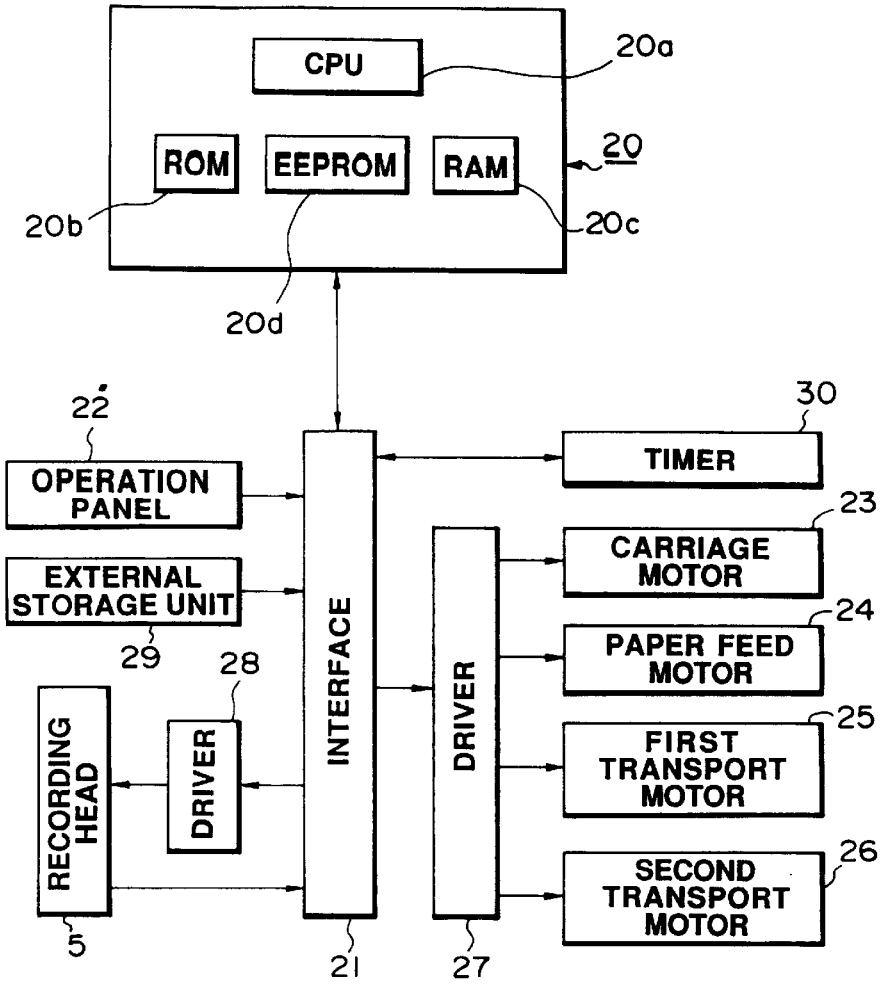
FIG. 2 is a block diagram showing a control structure of the ink jet recording apparatus shown in FIG. 1.
Figure 2A:
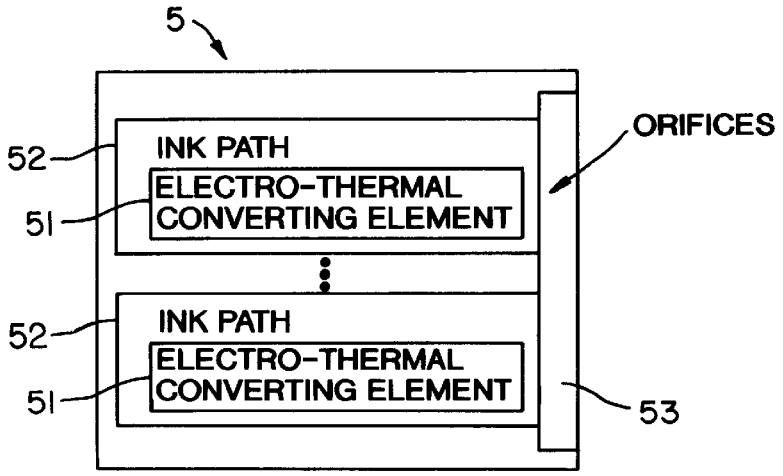
FIG. 2A is a block diagram showing further structure of a recording head used in an embodiment of the present invention.

FIG. 2 is a block diagram showing an example of a control system for controlling each part of the above mentioned ink jet recording apparatus.

In FIG. 2, a control part 20 is composed of, for example, a CPU 20*a* composed of microprocessors, a ROM 20*b* storing control programs for CPU 20*a* and various data, a RAM 20*c* which is used for a work area of CPU 20*a* and also used for storing various data temporarily and a non-volatile memory EEPROM 20*d* which is used for storing data such as the optimal number of times of ejection recovery operations after turning off the electric power supply, the number of times of automated ejection recovery operations performed and the number of times of manual ejection recovery operations performed so that these data may be stored and read independently on turning on or off of the electric power supply. An interface 21 transfers signals between the control part 20 and controlled parts to be described below. The operation panel 22 has input keys for users to input commands into the recording apparatus. A motor 23 for driving carriage, a motor 24 for driving the sheet supply roller, a motor 25 for driving a pair of the first transport rollers and a motor 26 for driving a pair of the second transport rollers are driven through the driver 27. The recording head 5 ejects ink fluids in responsive to driving signals from the head driver 28 based on the image signals supplied from the control part 20.

In the above described control system, the control part 20 accepts various information such as character pitch and character types specifying recording conditions through the interface 21 from the operation panel 22 and accepts image signals from an external storage unit 29 through the interface 21. In addition, the control part 20 supplies on-off signals to the driver 27 for driving motors 23 to 26 and image signals to the driver 28. And furthermore, the control part 20 sets or resets the timer 30 and accepts the elapsed time information measured by the timer 30.

In the above ink jet recording apparatus, for example, the ejection recovery operation for the recording head is required due to the following reasons as well as such accidental case as the orifice of the recording head is covered by the paper dust of the recording sheet.

As shown before, in the case that the ink jet recording head has not been used for ejecting ink fluids for a long period of time, the ink fluids in the neighboring area of the orifice may get to be viscous so that what may be caused is an unstable ejection of ink fluids. The ink fluids sealed within a tube connected between the ink tank and the sub-tank or between the sub-tank and the recording head may be getting viscous and the fluid resistance of ink fluids may increase. The amount of ink fluids in the sub-tank changes due to the evaporation of water component in the ink fluids. So far, it is required to establish an ink-fluid ejection recovery operation in order to cope with the increase in the viscosity of ink fluids due to the evaporation of water component in the ink fluids in the recording head or in the ink supply route from the ink tank to the recording head and the change of the amount of ink fluids.

However, in the apparatus structure where the ejection recovery operation is performed every time when the apparatus is turned on, there may occur many unnecessary recovery operations specifically for the user who often turns on and off the recording apparatus. In contrast, it may be possible to control the timing of the ejection recovery operations so as to start the respective ejection recovery operations at a designated time interval. Even in this case, as the timer is always operated to observe the designated time interval while the recording apparatus is turned off and thus, a back-up electric power supply such as batteries is required, such a similar problem related to a back-up electric supply method as be seen above may occur.

In this embodiment, as a designated number of times of ejection recovery operations are performed at a designated time interval after the electric power supply to the recording apparatus is turned on, it will be appreciated that the above problem can be solved.

In the followings, detail features of controlling the ejection recovery operations are described.

In this embodiment, the following three set of information are priorly stored in the EEPROM 20*d* as shown in FIG. 3. In the EEPROM 20*d*, P, the number of times of the automated ejection recovery operations to be performed at the time when the electric supply to the recording apparatus is turned on, is stored in the address n, AP, the number of times of the ejection recovery operations performed automatically, is stored in the address n+1, and MP, the number of times of the ejection recovery operations performed manually, is stored in the address n+2, with their initial values, P=1, and AP=MP=0.

In the above definition, a single ejection recovery operation is equivalent to a single evacuation action or a single pressurizing action of the ink fluid in the recording head or is equivalent to a unit of the predetermined number of times of these actions by the recovery apparatus described above. This single or the number of times of ejection recovery operations to be performed is determined in responsive to the specification of the recording apparatus. The automated ejection recovery operations (automatic ejection recovery operations) are those performed at a designated time interval after the electric power supply to the recording apparatus is turned on, and the manual ejection recovery operations are those performed by the request from the user or operator pressing down the input keys in the operation part. The actual recovery mechanism in the recovery apparatus is invoked by either of automated and manual recovery operations identically.

According to the above information, at the time when the electric power supply to the recording apparatus is turned on, a series of P times automated ejection recovery operations are continuously and sequentially performed, and after that, a designated number of times of automated ejection recovery operations are performed at a designated time interval, for example in this embodiment, 24 hours, that is, once in 24 hours. During the operation of the recording apparatus, when a single automated ejection recovery operation is performed, the value of AP is incremented, that is, AP=AP+1, and the incremented value is stored again in the address n+1 of the EEPROM 20*d*, and when a single manual ejection recovery operations is performed, the value of MP is incremented, that is, MP=MP+1, and the incremented value is stored again in the address n+2 of the EEPROM 20*d*.

When the counted number of times of the automated ejection recovery operations, the current value of AP, becomes to be greater than a designated number, the counted number of the manual ejection recovery operations is examined. In the case that this counted number of the manual ejection recovery operations is greater than a designated number, it is judged that the number of times of the automated ejection recovery operations performed currently is less than an adequate number of times of the automated ejection recovery operations generic to the condition under which the recording apparatus is operated by the user and the value of P, which defines the number of times of the automated ejection recovery operations performed continuously and sequentially at the time when the electric power supply to the recording apparatus is turned on, is increased. This means that the value P stored in the address n of EEPROM 20*d* is incremented. In contrast, in the case that the counted number of times of the manual ejection recovery operations is less than the designated number, the value P is decremented. In this embodiment, the above described judgment is performed at the time when the counted number of the automated ejection recovery operations is greater than 20. Specifically, if the counted number of the manual ejection recovery operations is greater than or equal to 2, the number of times of the automated ejection recovery operations to be performed when the electric power supply to the recording apparatus is turned on, P, is incremented; if the counted number is zero, P is decremented; and if the counted number is one, it is judged that the present operational condition of recording heads of the recording apparatus is adequate and hence, the number of times of the automated ejection recovery operations, P, is not changed.

Control procedures described above will be described in detail by referring to flow charts shown in FIGS. 4 to 6.

Figure 4:
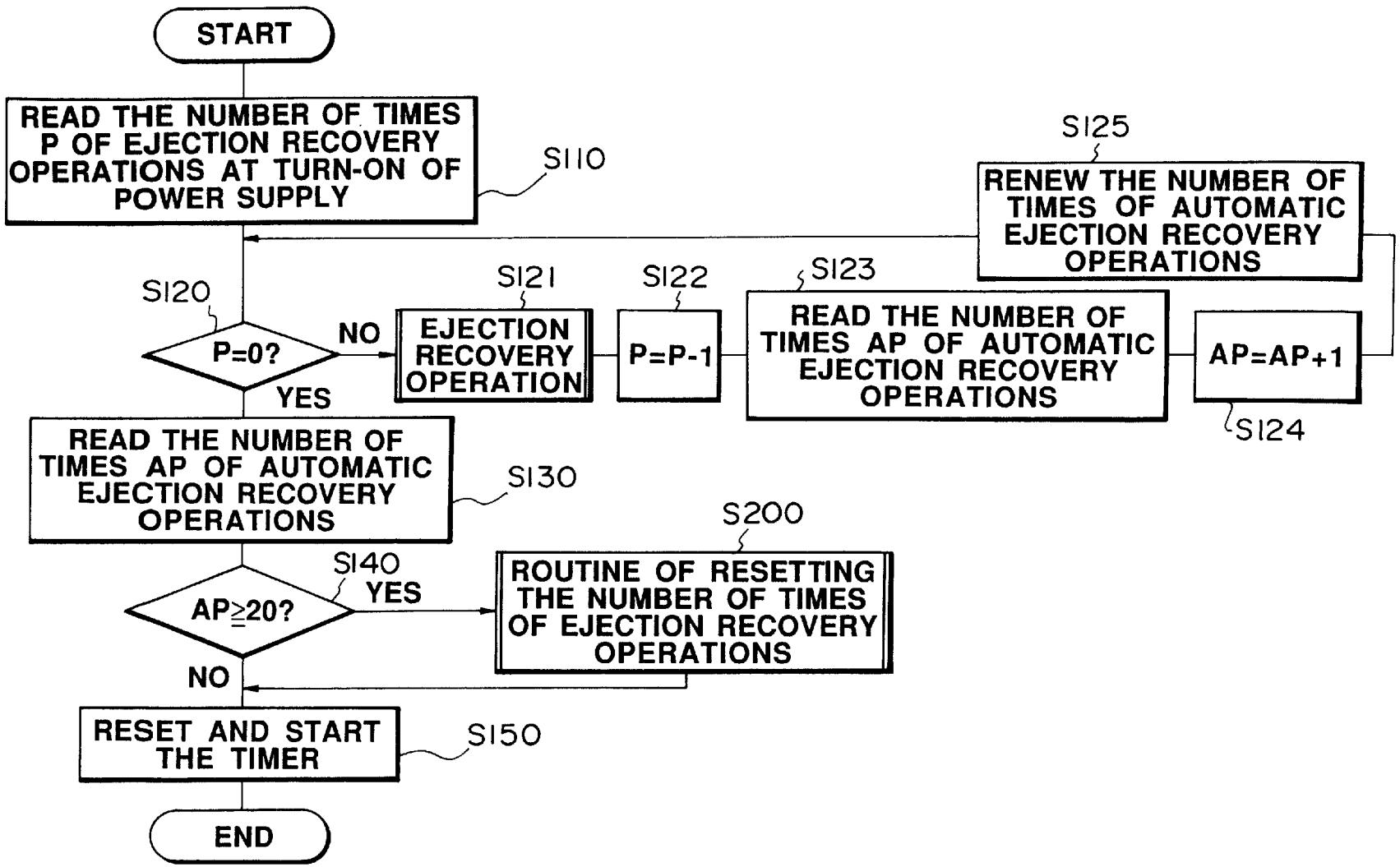
FIG. 4 is a flow chart showing procedures at the time when the electric power supply is turned on in first embodiment of the present invention.

FIG. 4 is a flow chart of procedures at the time just after the electric power supply is turned on.

When the electric power supply is turned on, in step S110, the optimal number P of cleaning (recovery) operations is read out from the memory address n of the EEPROM 20*d*, and is transferred and stored into RAM 20*c*. Next, a designated number of times of the automated ejection recovery operations are repeated until P reaches zero, that is, P=0. Until it is judged that P is not zero in step S120, a single ejection recovery operation is performed in step S121, and next the value of P is decremented in step S122, that is, P=P−1. Now that a single ejection recovery operation is performed, in step S123, the number AP of times of the automated ejection recovery operations having been performed until now is read out from the memory address n+1 of EEPROM 20*d*, and AP is incremented, that is, AP=AP +1, in step S124, and next, in step S125, the incremented value of AP is stored in the address n+1, and step S120 is reached again for judging the value P.

In the case that step S120 detects that all the P-times ejection recovery operations at the time after the electric power supply is turned on are performed, the value of AP is read out in step S130. In step S140, the value of AP is judged. In the case that AP is less than 20, the timer 30 is reset and restarted again in step S150, and finally procedures for performing ejection recovery operations at the time just after the electric power supply ends. In the case that AP is judged to be greater than or equal to 20 in step S140, step S200 is selected in order to call a reset routine for the number of times of the ejection recovery operations.

Figure 5:
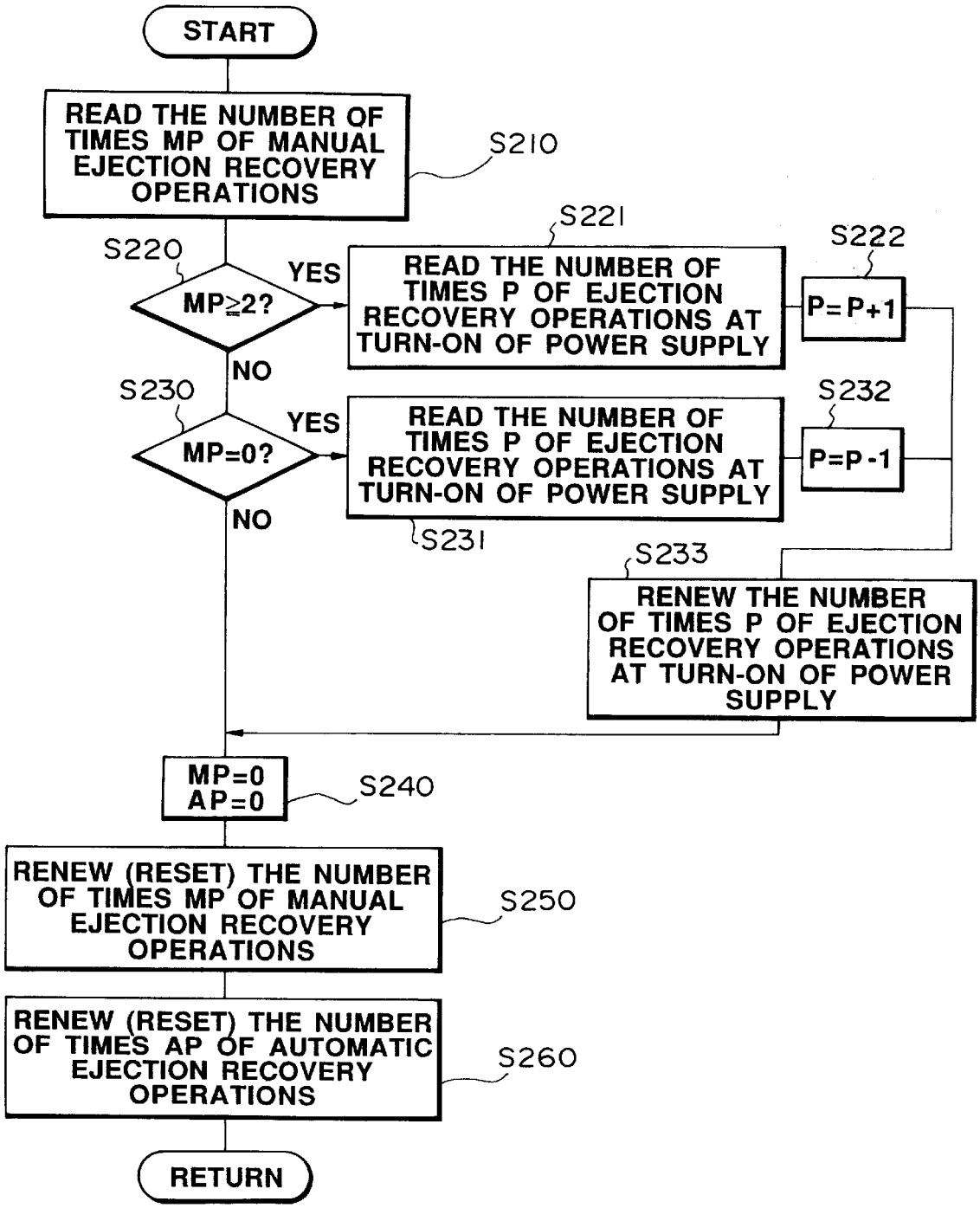
FIG. 5 is a flow chart showing a reset procedure for the number of times of ejection recovery operations shown in FIG. 4.

FIG. 5 is a flow chart showing a reset routine for the number of times of the ejection recovery operations. In step S210, the number MP of times of the manual ejection recovery operations stored in the address n+2 of the EEPROM 20*d* is read out. Next, in step S220, it is judged whether the value of MP is over 2 or not. In the case that MP is greater than or equal to 2, that is, the manual ejection recovery operations are performed twice or more during 20 times automated ejection recovery operations, it is judged that the currently predefined number of times of the automated ejection recovery operations is less than an optimal number generic to the operational condition of the recording apparatus for the user, and hence, the number P of times of the automated ejection recovery operations at the time just after the electric power supply is turned on, which is stored in the address n, is incremented. That is, P is incremented in steps S221, S222 and S233.

In contrast, in the case that step S220 determines that MP is less than 2 and that step S230 detects that MP is zero, it is concluded in steps S231, S232 and S233 that unnecessary automated ejection recovery operations are performed currently and that P is decremented.

After the above described modification procedures of the predefined number of times of the ejection recovery operations at the time just after the electric power supply ends, MP and AP are reset in step S240. Eventually, this means that the cumulative number AP of times of the automated ejection recovery operations and the cumulative number MP of times of the manual ejection recovery operations, both stored in the addresses n+1 and n+2 of EEPROM 20*d*, respectively, are initialized to be zeros in steps S250 and S260.

Step S150 shown in FIG. 4 is selected after the completion of the reset routine for the number of times of the ejection recovery operations, and in step S150, the timer is reset and restarted again, which is the end of control procedures performed at the time immediately after the electric power supply is turned on.

By referring to FIG. 6, what will be described below are control procedures for the recording apparatus where ordinary recording operations have not been performed after the electric power supply is turned on.

In the period of time during which ordinary recording operations are not performed after the electric power supply is turned on, the following three items are observed. One item is an interruption of a recording command. In the case of detecting a recording command in step S300, step S301 for the recording procedure routine is selected next where an ordinary recording procedure is performed by ejecting ink fluids from the recording head 5 in responsive to the movement of the carriage 6 shown in FIG. 1.

In the case that the recording command is not detected in step S300 or that the recording procedure is terminated in step S301, next in step S310, what is observed as the second observed item is an interruption of an ejection recovery operation command issued by the user operating input keys. In the case of accepting a manual ejection recovery operation command, a single ejection recovery operation is performed in step S311, and next in steps S312 to S314, the cumulative number of manual ejection recovery operations is incremented. Specifically, the value stored in the address n+2 of the EEPROM 20*d* is read out, incremented and stored back into the same address. After those procedures, in step S315, the timer 30 is reset and started again before step S320 is reached.

In the case that the manual ejection recovery operation command is not issued or that designated procedures for the single manual ejection recovery operation are terminated, what is observed in step S320 as the third observed item is the elapsed time measured by the timer. This timer is reset at the time when the electric power supply is turned on or immediately after the ejection recovery operation is performed. In this embodiment, the ejection recovery operation is not performed until the timer 30 counts up to 24 hours. Therefore, in such a case, step S300 is selected again for observing an interruption of the recording command. In the case that the timer 30 measured 24 hours or more, it is judged that the increase in the viscosity of ink fluids in the neighboring area of the orifices and the ink supply route and the change of the amount of ink fluids in the sub-tank may occur even if the recording operations are performed during the period of time counted by the timer for 24 hours or more. Therefore, it is judged that fresh ink fluids are required to be fed into the recording head by performing the ejection recovery operations and a routine for the ejection recovery operation are selected. In step S330, at first, a single ejection recovery operation is performed. Next, in steps S340, S350 and S360, the cumulative number AP of automated ejection recovery operation which is stored in the address of the EEPROM 20*d* is incremented. Next, in step S370, what is judged is whether the cumulative number AP of times of the automated ejection recovery operations is 20 or over. If the value of AP is 20 or over, what is selected next is step S200 for a reset routine for the number of times of the ejection recovery operations shown in FIG. 5 in order to establish an optimal number of times of the ejection recovery operations at the time when the electric power supply is turned on. And finally, in step S380, the timer is reset and restarted again before going back to step S300 for continuing the observation of an interruption of the recording command.

By controlling in the above described manner, is is not necessary to perform the ejection recovery operations at a designated time interval which is established by the timer driven by backup batteries for measuring elapsed time even in the when the electric power supply to the recording apparatus is turned off, and it is also not necessary to perform the ejection recovery operations without considering necessities at the time immediately after the electric power supply is turned on. Therefore, the ejection recovery operations for the recording head can be performed at an adequate time interval by considering such an operational condition of the recording apparatus as the occurrence of operations. So far, it will be appreciated that unnecessary waste of ink fluids can be prevented and the running cost of the recording apparatus can be reduced, and that an ink jet recording apparatus which enables to reduce the volume of the waste ink tank and the size of the recording apparatus can be provided.

Though the number of times of the ejection recovery operation is optimized in this embodiment, it may be allowed that a cleaning performance such as, for example, the amount of ink fluids evacuated in a single recovery operation is used as a criteria for optimization.

In addition, in stead of the number of times of the ejection recovery operations at the time after the electric power supply is turned on to be incremented or decremented indefinitely, by defining an upper-bound and a lower-bound, the number of times of the ejection recovery operations at the time after the electric power supply is turned on may be bounded within a designated range of value.

As the necessity of the ejection recovery operation is subject to the conditions with respect to the operational environment, the data corresponding to a designated value of the number of ejection recovery operations at the time after the electric power supply is turned on may be defined in a data format representing a designated relationship between environmental temperature and humidity.

Figure 6:
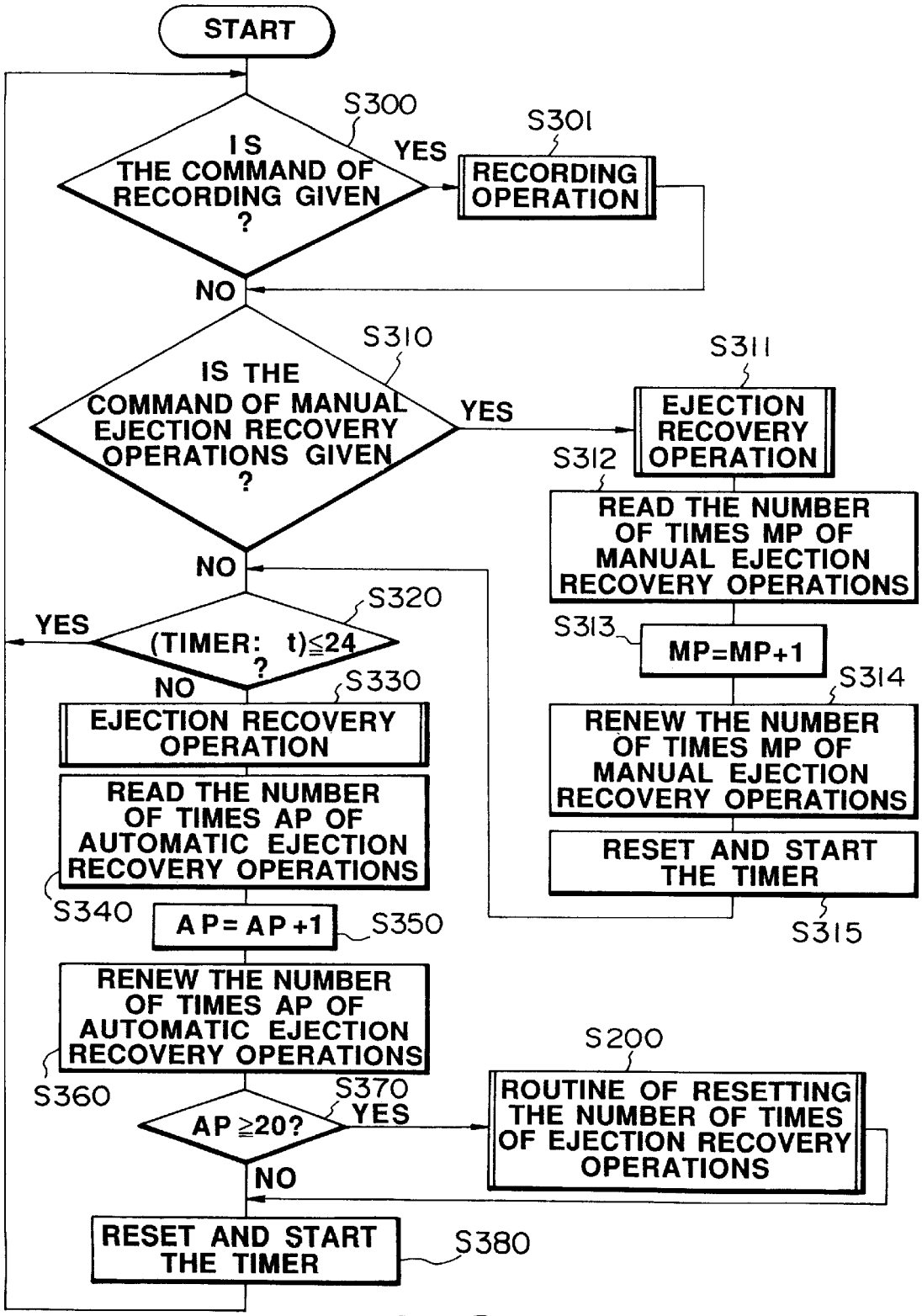
FIG. 6 is a flow chart showing procedures after the electric power supply is turned on in first embodiment of the present invention.

Parameters in this embodiment, for example, the branch criteria "2" used for judging MP≧2 in step S220 shown in FIG. 5, the parameter "0" used for judging MP=0 in step S230, the parameter "24" used for judging t≧24 in step S320 shown in FIG. 6 and the parameter "20" used for judging AP≧20, may be modified in responsive to the configuration of the recording apparatus and the operational conditions.

(EMBODIMENT 2)

Another embodiment for optimizing the time interval between adjacent ejection recovery operations is described below.

In the first embodiment described above, in the case that the occurrence of the manual ejection recovery operations is high, the operational condition of the recording head is optimized by varying the number of ejection recovery operations at the time when the electric power supply is turned on or by adjusting the amount of ink fluids evacuated at a single ejection recovery operation. It may be allowed that the time interval between adjacent ejection recovery operations is adjusted in a control of the ejection recovery operations when the recording head has not been used for recording since the electric power supply was turned on.

Figure 7:
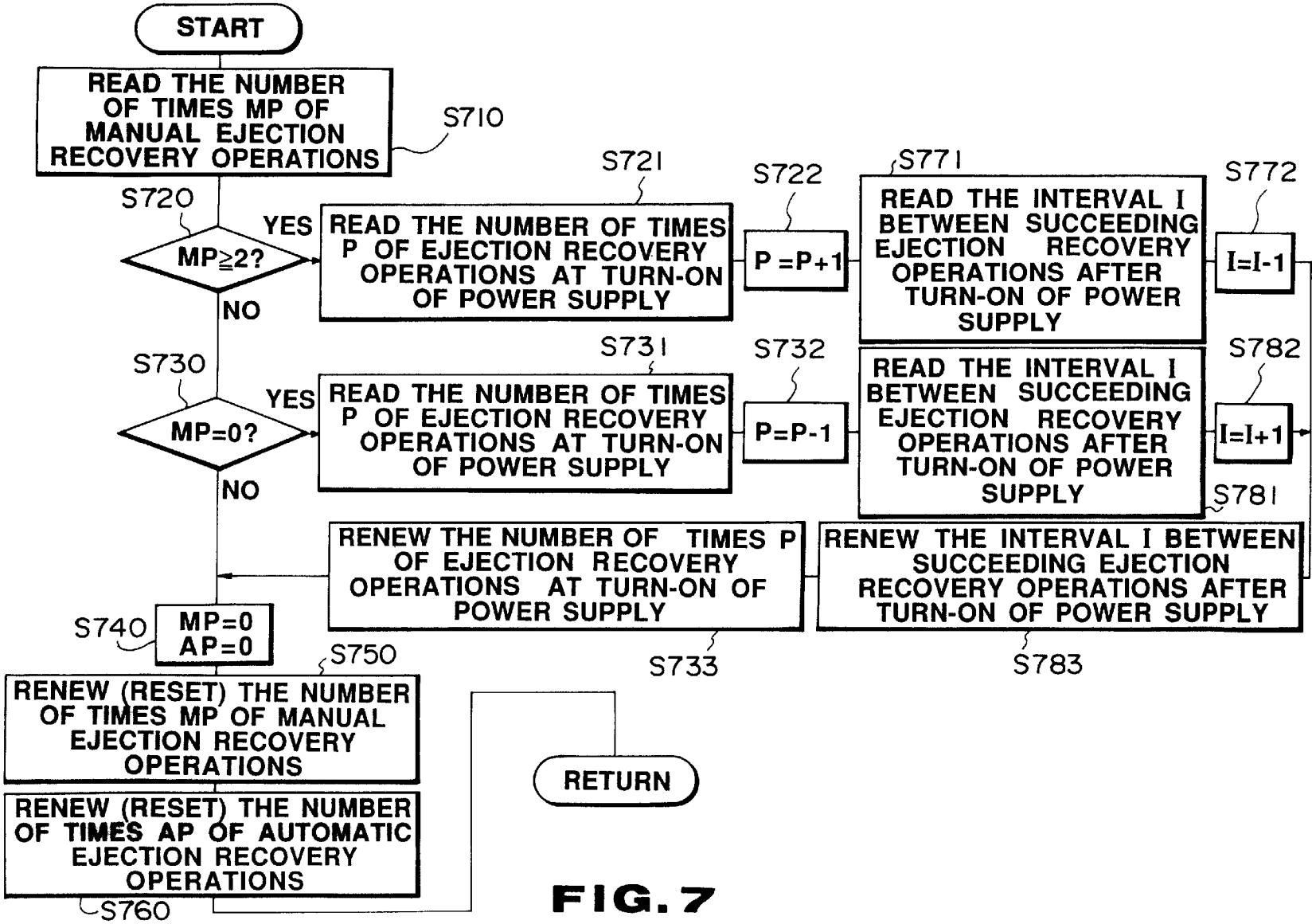
FIG. 7 is a flow chart showing a reset procedure for the number of times of ejection recovery operations in second embodiment of the present invention.

FIG. 7 is a flow chart of the reset routine for the number of times of the ejection recovery operations in this embodiment.

In this reset routine, similarly to the reset routine for the number of times of the ejection recovery operations as shown in FIG. 5, at first, what is judged is whether the occurrence of the manual ejection recovery operations is larger than that of the automated ejection recovery operations. In the first embodiment, if the occurrence of the manual ejection recovery operations is relatively larger, the operational condition is adjusted so that the number of times of the ejection recovery operations may be increased at the time immediately after the electric power supply is turned on. In this embodiment, in addition to the control method taken in the first embodiment, the operational condition may be established so that the time interval between adjacent ejection recovery operations may be shorten.

Figure 8:
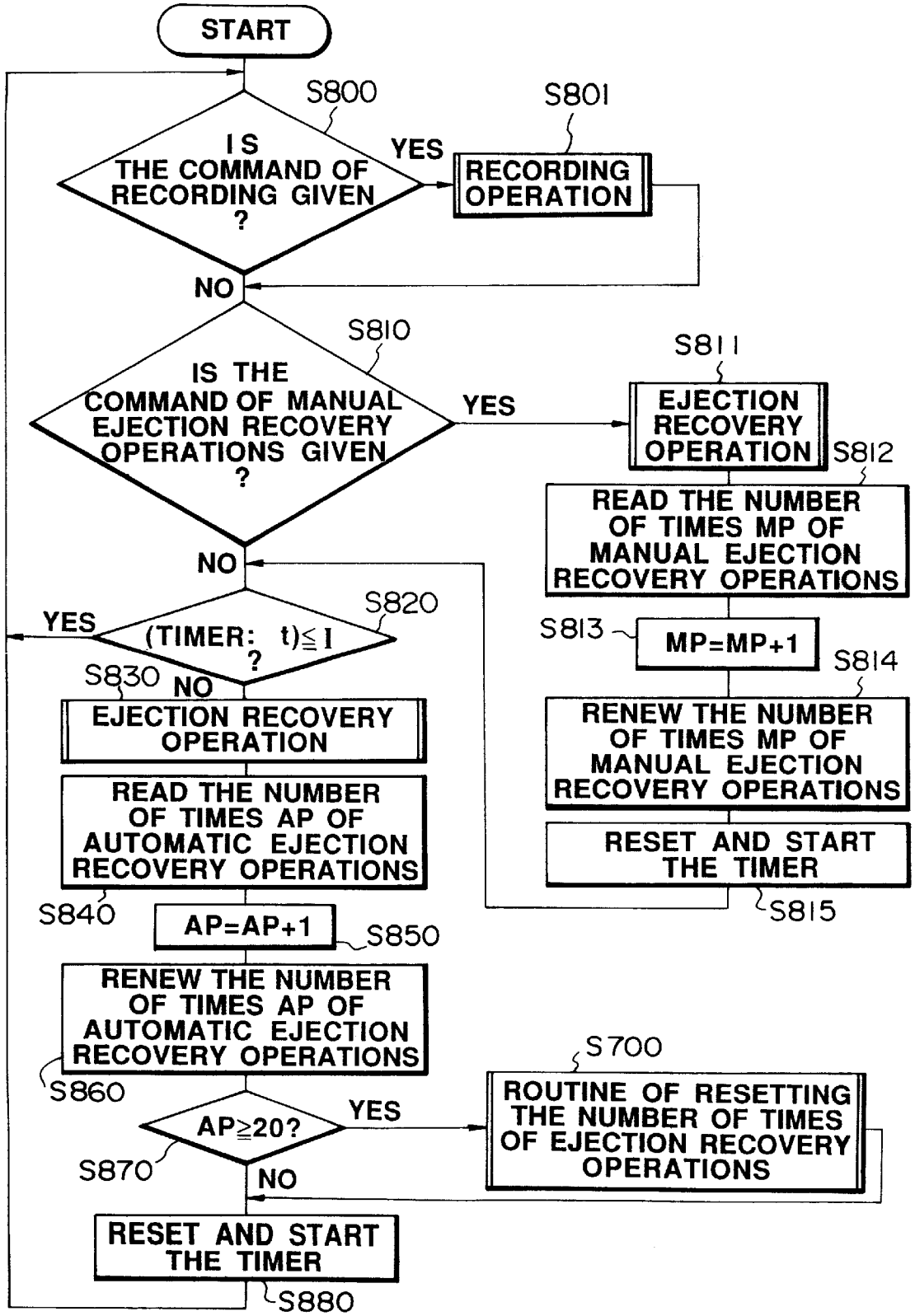
FIG. 8 is a flow chart showing procedures after the electric power supply is turned on in second embodiment of the present invention.

In order to realize this control method, a value I representing a time interval between adjacent ejection recovery operations which is measured by the timer is defined and stored in the address m of EEPROM 20*d* shown in FIG. 3. That is, the ejection recovery operations are performed every "I" hours, which can be referred from the address m, in step S820 in FIG. 8. Therefore, in the case that, in step S720 of FIG. 7, it is judged that the occurrence of the manual ejection recovery operations is relatively higher, the time interval between adjacent ejection recovery operations is made to be shorter by, in steps S721 and S722, incrementing the predefined number of times of the ejection recovery operations at the time when the electric power supply is turned on and by decrementing the time interval "I" for timer-operated ejection recovery operations in steps S771 and S772. In the similar manner, in the case that, in step S730 of FIG. 7, it is judged that the occurrence of the manual ejection recovery operations is relatively lower, the time interval between adjacent ejection recovery operations is made to be longer by incrementing the time interval "I" for timer-operated ejection recovery operations in steps S781 and S782.

It may be considered that the effect of the optimizing of the number of times of the ejection recovery operations performed in the manner described in the first embodiment seems to be less attractive for the user who doesn't turn on and off the recording apparatus so often. In the second embodiment, as the time interval between adjacent ejection recovery operations can be optimized in the case that the recording head has not been used for recording since the electric power supply was turned on, the operational conditions with respect to the ejection recovery operations can be established not only for the users who turn on and off the recording apparatus so frequently but also for those who don't turn on and off the recording apparatus so often.

Though both the number of ejection recovery operations and the time interval between consecutive operation recovery operations are optimized in the second embodiment, it may be allowed that only the time interval between consecutive operation recovery operations can be used as a criteria for optimization.

In this embodiment, both the time interval between consecutive ejection recovery operations and the number of times of the ejection recovery operations are optimized, however, it may be allowed that only the time interval is controlled.

And furthermore, in stead of adjusting the time interval between consecutive ejection recovery operations, it may be allowed that the amount of evacuated ink fluids is controlled.

In addition, either the time interval between consecutive ejection recovery operations or the amount of evacuated ink fluids from the orifice in the case that the recording head has not been used for recording since the electric power supply was turned on may be defined in a data format stored in EEPROM 20*d,* which represents a designated relationship between environmental temperature and humidity.

(EMBODIMENT 3)

Another embodiment for optimizing the time interval between consecutive ejection recovery operations is described below. In the second embodiment described above, though the time interval between consecutive ejection recovery operation can be adjustable in the case that the recording head has not been used for recording since the electric power supply was turned on, the value of the modified time interval in a single adjusting procedure is defined to be constant. It is not required to define the value of the modified time interval with respect to the value "I" in a single adjusting procedure to be constant, for example, +1 or −1. Now assume that ejection recovery operations have not been performed for a long period of time since the recording apparatus was turned off. In such a case, for a designated period of time immediately after the electric power supply is turned on, the value of the modified time interval is selected to be relatively small so that the time interval may not change so largely and that ejection recovery operations are performed within a relatively short period of time with a relatively short time interval. In the control procedure of the third embodiment, the value of the modified time interval in a single adjusting procedure is defined so as to be increased as the time passes after the electric power supply is turned on. In order to realize this control mechanism, for example, the time interval "I" is defined in terms of a function stored in EEPROM 20*d.* One of functions defining individual time interval adjusting values is selected optimally in responsive to the occurrence of the manual ejection recovery operations, and is used for calculating the value for adjusting the time interval for establishing ejection recovery operations in the case that the recording apparatus has not been used since the electric power supply was turned on.

Owing to such a control mechanism for reducing the number of times of the ejection recovery operations, it will be appreciated that unnecessary waste of ink fluids can be prevented and the running cost of the recording apparatus can be reduced, and that an ink jet recording apparatus which enables to reduce the volume of the waste ink tank and the size of the recording apparatus can be provided.

In stead of the above mentioned procedure in which the value of modified time interval in a single adjusting operation increases gradually as the recording apparatus is operated, the value of modified time interval in a single adjusting operation may be taken randomly, which leads to an establishment of more optimal operational conditions with respect to specific structures of the recording apparatus.

(EMBODIMENT 4)

Though, in the above described embodiments, the optimal number of times of the ejection recovery operations at the time when the electric power supply is turned on or the optimal time interval between adjacent ejection recovery operations is determined by the relative occurrence of the manual ejection recovery operations, it may be allowed that the mean duration time during which the electric power is continuously supplied to the recording apparatus is considered as an additive factor for the determination of those optimal parameters. That is, the mean duration time is calculated from several sampled data stored in EEPROM 20*d* on the duration time during which the electric power is supplied to the recording apparatus, and the optimal number of times of the ejection recovery operations at the time when the electric power supply is turned on or the optimal time interval between adjacent ejection recovery operations is determined by the average duration time.

In the case of the recording apparatus used so as to be turned on and off so frequently, as the average time during which the electric power is continuously supplied to the recording apparatus is short, the previously mentioned ejection recovery operation by the timer is not performed so often while the recording apparatus is not operated for recording after the electric power supply to the apparatus was turned on. Therefore, in such an operational condition, it is more effective to perform the ejection recovery operations immediately after the electric power supply to the recording apparatus is turned on. For example, in the case that the average time during which the electric power is continuously supplied to the recording apparatus is less than five hours, the number P of times of the ejection recovery operations is reduced by 2, that is, P=P−2.

In contrast, in the case that the electric power supply to the recording apparatus is not turned on and off so frequently, the time interval "I" between adjacent ejection recovery operations while the recording head is not used for recording is increased or decreased by 2 times units so that an optimal ejection recovery operation may be performed in responsive to the actual operational conditions generic to individual users.

As the present invention establishes an optimal ejection recovery operation with respect to the most recent operational condition, in the case that the operational condition changes drastically by the user's choice, the optimality of the recovery operation cannot maintained to be valid. Even in this case, in this embodiment, the average duration time during which the electric power supply to the recording apparatus continues is stored in accordance with the individual user's operational history, the drastic change in the operational condition can be detected by the change in the average duration time stored in the memory. So far, for example, in the case that the duration time averaged over the past ten times of turning on and off the recording apparatus is more than twice of the average duration time stored as the long time history data of the operational conditions, the operational condition is considered to be changed drastically and hence, it may be possible to control the ejection recovery operation by establishing the optimal parameters by using the most recent detected data.

According to the present invention, as an adequate ejection recovery operation can be performed at the necessary occasion, it will be appreciated that conventional manual procedures or input keys by the user for invoking the ejection recovery operations can be removed. In this case, it will be appreciated that an inhibit mode is realized by the "need-not-use" mode of the manual recovery input key and that an indication of "enabling-good-conditioned-recording-without-recovery-operations" can be displayed.

As found to be apparent from the above description, according to the present invention, the number of times of the ejection recovery operations is determined based on the number of times of the ejection recovery operations performed in the past and the occurrence of operating the recording apparatus for recording. Owing to this way, an adequate ejection recovery operation can be established in accordance with the operational condition of the recording apparatus and its occurrence of operations. As a result, it will be appreciated that unnecessary waste of ink fluids can be prevented and the running cost of the recording apparatus can be reduced, and that an ink jet recording apparatus which enables to reduce the volume of the waste ink tank and the size of the recording apparatus can be provided.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus using a recording head, the recording head having an ejection condition in which the recording head ejects an ink fluid onto a recording medium, the apparatus comprising:

an ejection recovery means for performing ejection recovery operations for maintaining a desired said ejection condition of said recording head by causing the ink fluid to flow in said recording head;

an automatic recovery operation control means for causing said ejection recovery means to perform an ejection recovery operation on a predetermined occasion;

an input means for inputting a command to the ejection recovery means to perform an ejection recovery operation in response to an action of a user of said ink jet recording apparatus;

a memory means for memorizing a first number and a second number, the first number being a number of times that the ejection recovery operations have been performed by said ejection recovery means in response to the command inputted by said input means and the second number being a number of times that the ejection recovery operations have been performed by said ejection recovery means in response to being caused by said automatic recovery operation control means; and a recovery operation amount control means for controlling an upcoming amount of an ejection recovery operation to be performed by said ejection recovery means based on the first number and the second number memorized by said memory means.

2. An ink jet recording apparatus as claimed in claim 1, wherein said recovery operation amount control means controls at least one of the number of times that said ejection recovery operations are performed by said ejection recovery means when an electric power supply to said ink jet recording apparatus is turned on, and a time interval between said ejection recovery operations performed by said ejection recovery means after said electric power supply is turned on.

3. An ink jet recording apparatus as claimed in claim 2, wherein said recovery operation amount control means controls at least one of the number of times of said ejection recovery operations and the time interval between said ejection recovery operations in response to at least one of a temperature and a humidity with respect to said recording head.

4. An ink jet recording apparatus as claimed in claim 3, wherein the time interval between the ejection recovery operations has a control amount, and said ejection recovery operation amount control means controls the time interval between the ejection recovery operations so that the control amount of the time interval is varied.

5. An ink jet recording apparatus as claimed in claim 4, wherein said recording head has a thermal energy generating means for generating thermal energy, generates a bubble by using thermal energy generated by said thermal energy generating means, and ejects the ink fluid as a result of generation of said bubble.

6. An ink jet recording apparatus as claimed in claim 1, wherein said recovery operation amount control means controls an amount of the ink fluid which is caused to flow during said ejection recovery operation.

7. An ink jet recording apparatus as claimed in claim 6, wherein said recovery operation amount control means controls the amount of the ink fluid which is caused to flow during said ejection recovery operation is controlled in response to at least one of a temperature and a humidity with respect to said recording head.

8. An ink jet recording apparatus as claimed in claim 7, wherein said recording head has a thermal energy generating means for generating thermal energy, generates a bubble by using thermal energy generated by said thermal energy generating means, and ejects the ink fluid as a result of generation of said bubble.

9. An ink jet recording apparatus using a recording head, the recording head having an ejection condition in which the recording head ejects an ink fluid onto a recording medium, the apparatus comprising;

an ejection recovery means for performing ejection recovery operations for maintaining a desired said ejection condition of said recording head by causing the ink fluid to flow in said recording head;

an automatic recovery operation control means for causing said ejection recovery means to perform an ejection recovery operation on a predetermined occasion;

a memory means for memorizing a duration time commencing when an electric power supply to said ink jet recording apparatus is turned on and ending when the electric power supply is turned off; and recovery operation amount control means for controlling at least one of the number of times that the ejection recovery operations are performed by said ejection recovery means when the electric power supply to said ink jet recording apparatus is turned on, and a time interval between the ejection recovery operations which have been performed by said ejection recovery means after said electric power supply is turned on in response to said duration time memorized by said memory means, said ejection recovery operations being initiated by said automatic recovery operation control means.

10. An ink jet recording apparatus as claimed in claim 9, wherein said duration time is an average of a plurality of duration times in each of which said electric power supply is turned on.

11. An ink jet recording apparatus as claimed in claim 10, wherein said recovery operation amount control means controls at least one of the number of times of said ejection recovery operations and the time interval between said ejection recovery operations in response to at least one of a temperature and a humidity with respect to said recording head.

12. An ink jet recording apparatus as claimed in claim 11, wherein the time interval between the election recovery operations has a control amount, and said ejection recovery operation amount control means controls the time interval between the ejection recovery operations so that the control amount of the time interval is varied.

13. An ink jet recording apparatus as claimed in claim 12, wherein said recording head has a thermal energy generating means for generating thermal energy, generates a bubble by using thermal energy generated by said thermal energy generating means, and ejects the ink fluid as a result of generation of said bubble.

14. An ink jet recording apparatus as claimed in claim 10, wherein said recovery operation amount control means controls an amount of the ink fluid which is caused to flow during said ejection recovery operation.

15. An ink jet recording apparatus as claimed in claim 14, wherein said recovery operation amount control means controls the amount of the ink fluid which is caused to flow during said ejection recovery operation in response to at least one of a temperature and a humidity with respect to said recording head.

16. An ink jet recording apparatus as claimed in claim 15, wherein said recording head has a thermal energy generating means for generating thermal energy, generates a bubble by using thermal energy generated by said thermal energy generating means, and ejects the ink fluid as a result of generation of said bubble.

17. An ink jet recording apparatus using a recording head, the recording head having an ejection condition in which the recording head ejects an ink fluid from said recording head onto a recording medium, the apparatus comprising:

an ejection recovery means for performing an ejection recovery operation for maintaining a desired said ejection condition of said recording head by causing the ink fluid to flow in said recording head, said ejection recovery means performing the ejection recovery operation on a predetermined occasion and on an occasion in which a user of said ink jet recording apparatus commands said ejection recovery means to perform the ejection recovery operation;

a detecting means for detecting a previous occurrence of operating said ink jet recording apparatus for recording; and a recovery operation amount control means for controlling at least an upcoming amount for the ejection recovery operation performed on the predetermined occasion, in response to a result of detection by said detecting means.

* * * * *

UNITED STATES PATENT AND TRADEMARK OFFICE

CERTIFICATE OF CORRECTION

PATENT NO. : 6,227,646 B1
DATED : May 8, 2001
INVENTOR(S) : Yano et al.

It is certified that error appears in the above-identified patent and that said Letters Patent is hereby corrected as shown below:

Title page,
FOREIGN PATENT DOCUMENTS, "1202454" should read -- 1-202454 --.

Column 2,
Lines 30 and 61, "responsive" should read -- response --.

Column 3,
Lines 13 and 38, "responsive" should read -- response --.

Column 4,
Lines 42, 50 and 56, "responsive" should read -- response --.

Column 6,
Line 13, "be" should be deleted;
Line 21, "set" should read -- sets --; and
Line 41, "responsive" should read -- response --.

Column 7,
Line 3, "be" should be deleted.

Column 8,
Line 46, "responsive" should read -- response --.

Column 9,
Line 33, "the" (first occrurrence) should be deleted; and
Line 52, "in stead" should read -- instead --.

Column 10,
Line 4, "responsive" should read -- response --; and
Line 39, "shorten." should read -- shortened. --.

Column 12,
Line 6, "In stead" should read -- Instead --.

Column 14,
Line 44, "be" should be deleted.

It is certified that error appears in the above-identified patent and that said Letters Patent is hereby corrected as shown below:

Column 18,
Line 26, the following claims should be inserted:

-- 18. An ink jet recording apparatus using a recording head ejecting an ink to perform recording onto a recording medium, the apparatus comprising:

recovery means for performing recovery operations for maintaining a desired state of an ejection condition of said recording head by causing the ink to be expelled from said recording head;

automatic recovery operation control means for causing said recovery means to perform a recovery operation on a predetermined occasion;

input means for inputting a command to the recovery means to perform a recovery operation in response to an action of a user of said ink jet recording apparatus;

memory means for memorizing a number of times that the recovery operations have been performed by said recovery means in response to the command inputted by said input means; and recovery operation control means for controlling the recovery operation performed by said recovery means, which is caused to perform the recovery operation by said automatic recovery operation control means, in accordance with said number of times, said recovery operation control means controlling an amount of the ink expelled from the recording head during the recovery operation.

19. An ink jet recording apparatus as claimed in Claim 18, wherein said recovery operation control means controls the amount of ink expelled during the recovery operation caused by said automatic recovery operation control means to be made greater when the number of times memorized by said memory means is greater than a predetermined number of times.

20. An ink jet recording apparatus as claimed in Claim 18, wherein said recovery operation control means controls the amount of ink expelled during the recovery operation caused by said automatic recovery operation control means to be made smaller when the number of times memorized by said memory means is smaller than a predetermined number of times.

21. An ink jet recording apparatus as claimed in Claim 18, wherein said recovery operation control means controls at least one of the number of times that said recovery operations are performed by said recovery means when an electric power supply to said ink jet recording apparatus is turned on, and a time interval between said recovery operations performed by said recovery means after said electric power supply is turned on.

It is certified that error appears in the above-identified patent and that said Letters Patent is hereby corrected as shown below:

22. An ink jet recording apparatus as claimed in Claim 21, wherein said recovery operation control means controls at least one of the number of times of said recovery operations and the time interval between said recovery operations in response to at least one of a temperature and a humidity with respect to said recording head.

23. An ink jet recording apparatus as claimed in Claim 22, wherein the time interval between the recovery operations has a control amount, and said recovery operation control means controls the time interval between the recovery operations so that the control amount of the time interval is varied.

24. An ink jet recording apparatus as claimed in Claim 23, wherein said recording head has a thermal energy generating means for generating thermal energy, generates a bubble by using thermal energy generated by said thermal energy generating means, and ejects the ink fluid as a result of generation of said bubble.

25. An ink jet recording apparatus as claimed in Claim 18, wherein said recovery operation control means controls an amount of the ink fluid which is caused to flow during said recovery operation.

26. An ink jet recording apparatus as claimed in Claim 25, wherein said recovery operation control means controls the amount of the ink fluid which is caused to flow during said recovery operation in response to at least one of a temperature and a humidity with respect to said recording head.

27. An ink jet recording apparatus as claimed in Claim 26, wherein said recording head has a thermal energy generating means for generating thermal energy, generates a bubble by using thermal energy generated by said thermal energy generating means, and ejects the ink fluid as a result of generation of said bubble.

28. A recovery operation control method in an ink jet recording appartus using a recording head ejecting an ink to perform recording onto a recording medium, the apparatus including recovery means for performing a recovery operation for maintaining a desired state of an ejection condition of said recording head by causing the ink to be expelled from said recording head, automatic recovery operation control means for causing said recovery means to perform a recovery operation on a predetermined occasion, and input means for inputting a command to the recovery means to perform a recovery operation in response to an action of a user of said ink jet recording apparatus, said method comprising the steps of:

a memory step for memorizing a number of times that the recovery operations have been performed by said recovery means in response to the command inputted by said input means; and It is certified that error appears in the above-identified patent and that said Letters Patent is hereby corrected as shown below:

an automatic recovery step for making said automatic recovery operation control means cause said recovery means to perform the recovery operation, said automatic recovery step controlling an amount of the ink expelled from the recording head during the recovery operation in accordance with the number of times memorized by said memory step.

29. A recovery operation control method as claimed in Claim 28, wherein said automatic recovery step controls at least one of the number of times that said recovery operations are performed by said recovery means when an electric power supply to said ink jet recording apparatus is turned on, and a time interval between said recovery operations performed by said recovery means after said electric power supply is tuned on.

30. A recovery operation control method as claimed in Claim 29, wherein said automatic recovery step controls at least one of the number of times of said recovery operations and the time interval between said recovery operations in response to at least one of a temperature and a humidity with respect to said recording head.

31. A recovery operation control method as claimed in Claim 30, wherein the time interval between the recovery operations has a control amount, and said automatic recovery step controls the time interval between the recovery operations so that the control amount of the time interval is varied.

32. A recovery operation control method as claimed in Claim 31, wherein said recording head has a thermal energy generating means for generating thermal energy, generates a bubble by using thermal energy generated by said thermal energy generating means, and ejects the ink fluid as a result of generation of said bubble.

33. A recovery operation control method as claimed in Claim 28, wherein said automatic recovery step controls an amount of the ink fluid which is caused to flow during said recovery operation.

34. A recovery operation control method as claimed in Claim 33, wherein said automatic recovery step controls the amount of the ink fluid which is caused to flow during said recovery operation in response to at least one of a temperature and a humidity with respect to said recording head.

It is certified that error appears in the above-identified patent and that said Letters Patent is hereby corrected as shown below:

35. A recovery operation control method as claimed in Claim 34, wherein said recording head has a thermal energy generating means for generating thermal energy, generates a bubble by using thermal energy generated by said thermal energy generating means, and ejects the ink fluid as a result of generation of said bubble.

36. A recovery operation control method in an ink jet recording apparatus using a recording head ejecting an ink to perform recording onto a recording medium, the apparatus including recovery means for performing recovery operations for maintaining a desired state of ejection condition of said recording head by causing the ink to be expelled from said recording head, said method comprising the steps of:

a memory step for memorizing a duration time commencing when an electric power supply to said ink jet recording apparatus is turned on and ending when the electric power supply is turned off; and an automatic recovery step for causing said recovery means to perform the recovery operation on a predetermined occasion, wherein said automatic recovery step controls at least one of (i) an amount of the ink expelled during the recovery operation performed when the electric power supply to said ink jet recording apparatus is turned on and off, and (ii) a time interval between the recovery operations which are performed by said recovery means after the electric power supply is turned on, in accordance with the duration time memorized by said memory step.

37. A recovery operation control method as claimed in Claim 36, wherein said automatic recovery step controls at least one of an amount of the ink expelled and the time interval between said recovery operations in response to at least one of a temperature and a humidity with respect to said recording head.

38. A recovery operation control method as claimed in Claim 37, wherein the time interval between the recovery operations has a control amount, and said automatic recovery step controls the time interval between the recovery operations so that the control amount of the time interval is varied.

39. A recovery operation control method as claimed in Claim 38, wherein said recording head has a thermal energy generating means for generating thermal energy, generates a bubble by using thermal energy generated by said thermal energy generating means, and ejects the ink fluid as a result of generation of said bubble.

It is certified that error appears in the above-identified patent and that said Letters Patent is hereby corrected as shown below:

40. A recovery operation control method as claimed in Claim 36, wherein said automatic recovery step controls an amount of the ink fluid which is caused to be expelled during said recovery operation.

41. A recovery operation control method as claimed in Claim 40, wherein said automatic recovery step controls the amount of the ink fluid which is caused to be expelled during said recovery operation in response to at least one of a temperature and a humidity with respect to said recording head.

42. A recovery operation control method as claimed in Claim 41, wherein said recording head has a thermal energy generating means for generating thermal energy, generates a bubble by using thermal energy generated by said thermal energy generating means, and ejects the ink fluid as a result of generation of said bubble.

43. An ink jet recording apparatus as claimed in Claim 36, wherein said duration time is an average of a plurality of duration times in each of which said electric power supply is turned on.

44. A recovery operation control method in an ink jet recording apparatus using a recording head, the recording head having an ejection condition in which the recording head ejects an ink fluid onto a recording medium, the apparatus including recovery means for performing recovery operations for maintaining a desired said ejection condition of said recording head by causing the ink fluid to flow in said recording head, an input means for inputting a command to the recovery means to perform a recovery operation in response to an action of a user of said ink jet recording apparatus, and an automatic recovery operation control means for causing said recovery means to perform a recovery operation on a predetermined occasion, the method comprising the steps of:

a memory step for memorizing a first number and a second number, the first number being a number of times that the recovery operations have been performed by said recovery means in response to the command inputted by said input means and the second number being a number of times that the recovery operations have been performed by said recovery means in response to being caused by said automatic recovery operation control means; and a recovery operation amount control step for controlling an upcoming amount of recovery operations to be performed by said recovery means based on the first number and the second number memorized by said memory step.

It is certified that error appears in the above-identified patent and that said Letters Patent is hereby corrected as shown below:

45. A recovery operation control method as claimed in Claim 44, wherein said recovery operation amount control step controls at least one of the number of times that said recovery operations are performed by said recovery means when an electric power supply to said ink jet recording apparatus is turned on, and a time interval between said recovery operations performed by said recovery means after said electric power supply is turned on.

46. A recovery operation control method as claimed in Claim 45, wherein said recovery operation amount control step controls at least one of the number of times of said recovery operations and the time interval between said recovery operations in response to at least one of a temperature and a humidity with respect to said recording head.

47. A recovery operation control method as claimed in Claim 46, wherein the time interval between the recovery operations has a control amount, and said recovery operation amount control step controls the time interval between the recovery operations so that the control amount of the time interval is varied.

48. A recovery operation control method as claimed in Claim 47, wherein said recording head has a thermal energy generating means for generating thermal energy, generates a bubble by using thermal energy generated by said thermal energy generating means, and ejects the ink fluid as a result of generation of said bubble.

49. A recovery operation control method as claimed in Claim 44, wherein said recovery operation amount control step controls an amount of the ink fluid which is caused to flow during said recovery operation.

50. A recovery operation control method as claimed in Claim 49, wherein said recovery operation amount control step controls the amount of the ink fluid which is caused to flow during said recovery operation in response to at least one of a temperature and a humidity with respect to said recording head.

51. A recovery operation control method as claimed in Claim 50, wherein said recording head has a thermal energy generating means for generating thermal energy, generates a bubble by using thermal energy generated by said thermal energy generating means, and ejects the ink fluid as a result of generation of said bubble.

It is certified that error appears in the above-identified patent and that said Letters Patent is hereby corrected as shown below:

52. A recovery operation control method in an ink jet recording apparatus using a recording head, the recording head having an ejection condition in which the recording head ejects an ink fluid from said recording head onto recording medium, the apparatus including recovery means for performing a recovery operation for maintaining a desired said ejection condition of said recording head by causing the ink fluid to flow in said recording head, said recovery means performing the recovery operation on a predetermined occasion and on an occasion in which a user of said ink jet recording apparatus commands said recovery means to perform the recovery operation, the method comprising the steps of:

a detecting step for detecting a frequency of operation of the recording head operated in relation to a recording operation of said ink jet recording apparatus as previously performed; and a recovery operation amount control step for controlling at least an upcoming amount for the recovery operation performed on the predetermined occasion, in response to said frequency of operation detected by said detecting means.

53. A recovery operation control method as claimed in Claim 52, wherein said recovery operation amount control step controls a number of times that said recovery operations are performed by said recovery means when an electric power supply to said ink jet recording apparatus is turned on, and a time interval between said recovery operations performed by said recovery means after said electric power supply is turned on.

54. A recovery operation control method as claimed in Claim 53, wherein said recovery operation amount control step controls the number of times of said recovery operations and the time interval between said recovery operations in response to at least one of a temperature and a humidity with respect to said recording head.

55. A recovery operation control method as claimed in Claim 54, wherein the time interval between the recovery operations has a control amount, and said recovery operation amount control step controls the time interval between the recovery operations so that the control amount of the time interval is varied.

56. A recovery operation control method as claimed in Claim 55, wherein said recording head has a thermal energy generating means for generating thermal energy, generates a bubble by using thermal energy generated by said thermal energy generating means, and ejects the ink fluid as a result of generation of said bubble.

UNITED STATES PATENT AND TRADEMARK OFFICE

CERTIFICATE OF CORRECTION

PATENT NO. : 6,227,646 B1
DATED : May 8, 2001
INVENTOR(S) : Yano et al.

It is certified that error appears in the above-identified patent and that said Letters Patent is hereby corrected as shown below:

57. A recovery operation control method as claimed in Claim 52, wherein said recovery operation amount control step control an amount of the ink fluid which is caused to flow during said recovery operation.

58. A recovery operation control method as claimed in Claim 57, wherein said recovery operation amount control step controls the amount of the ink fluid which is caused to flow during said recovery operation in response to at least one of a temperature and a humidity with respect to said recording head.

59. A recovery operation control method as claimed in Claim 58, wherein said recording head has a thermal energy generating means for generating thermal energy, generates a bubble by using thermal energy generated by said thermal energy generating means, and ejects the ink fluid as a result of generation of said bubble. --

Signed and Sealed this

Twenty-third Day of April, 2002

*Attest:*

*Attesting Officer*

JAMES E. ROGAN
*Director of the United States Patent and Trademark Office*